US006154130A

United States Patent [19]

Mondejar et al.

[11] Patent Number: 6,154,130

[45] Date of Patent: Nov. 28, 2000

[54] PORTABLE ROOM SECURITY SYSTEM

[76] Inventors: Nidia M. Mondejar; John P. Mondejar, both of P.O. Box 77691, Washington, D.C. 20013

[21] Appl. No.: 09/201,810

[22] Filed: Dec. 1, 1998

Related U.S. Application Data

[60] Provisional application No. 60/067,977, Dec. 9, 1997.

[51] Int. Cl.[7] ..... G08B 19/00

[52] U.S. Cl. ..... 340/521; 340/546; 340/693.5; 340/693.6; 340/693.9; 340/321

[58] Field of Search ..... 340/521, 546, 340/691.1, 693.5, 693.6, 693.9, 693.11, 693.12, 321, 326, 568.4

[56] References Cited

U.S. PATENT DOCUMENTS

| | | | |
|---|---|---|---|
| D. 260,741 | 9/1981 | Lam | D10/104 |
| D. 275,936 | 10/1984 | Coyer | D10/104 |
| D. 359,251 | 6/1995 | Tallent | D10/104 |
| 4,258,359 | 3/1981 | McLamb | 340/546 |
| 4,404,550 | 9/1983 | Shaw | 340/628 |
| 4,438,428 | 3/1984 | Ober et al. | 340/521 |
| 4,540,980 | 9/1985 | Porco | 340/586 |
| 4,617,561 | 10/1986 | Brown | 340/628 |
| 4,862,141 | 8/1989 | Jordal | 340/521 |
| 4,959,637 | 9/1990 | Woods et al. | 340/539 X |
| 5,072,212 | 12/1991 | Sorenson | 340/546 |
| 5,309,145 | 5/1994 | Branch et al. | 340/540 |
| 5,587,704 | 12/1996 | Foster | 340/326 X |
| 5,604,483 | 2/1997 | Giangardella et al. | 340/565 |

FOREIGN PATENT DOCUMENTS

| | | |
|---|---|---|
| 2280295 | 1/1995 | United Kingdom . |
| 92/10820 | 6/1992 | WIPO . |

*Primary Examiner*—Daryl C Pope
*Attorney, Agent, or Firm*—Richard C. Litman

[57] ABSTRACT

A portable room safety security system for use in hotel rooms, apartments, vehicles having sleeping areas (such as motor homes, RV's, trailers, etc.) and the like. The system integrates into a single housing a smoke detector and a movement sensor, both serially connected to an audio alarm and a visual alert. The system further includes a magnetically isolated slot for holding hotel key cards, as well as a series of hooks for holding several key rings. Also available is a bracket mounted to the housing for holding a flashlight. The system is optionally operated using a remote control device, and may include circuitry enabling automatic telephone dialing to alert outside assistance in the event of an alarm. Two types of structure may be used to suspend the device from an associated door. The first is a pliable extension bar and hook which suspends the device from a door knob. The second is a bracket extension piece enabling the device to be hung from the top of a door. This version is particularly useful to prevent small children from altering the settings.

7 Claims, 3 Drawing Sheets

PORTABLE ROOM SECURITY SYSTEM

CROSS-REFERENCE TO RELATED APPLICATION

This application claims the benefit of U.S. Provisional Patent Application Serial No. 60/067,977, filed Dec. 9, 1997.

BACKGROUND OF THE INVENTION

1. Field of the Invention

The present invention relates generally to portable devices which alert the user to the existence of a variety of ambient conditions and, more specifically, to such devices which sense combustion products, high-pitched and continuous sound as emitted by other emergency alarms and physical motion indicative of unwanted intrusion.

2. Description of Related Art

The consuming public has long been convinced of the value of fire and burglar alarm protection for use in travel, particularly while lodging in hotels and motels. Often, such locations are ill-equipped with regard to security against intruders, and either lack smoke detectors or are equipped with non-working ones. For these reasons, a substantial industry has grown up engaged in manufacturing portable security devices to accommodate these needs, and patents relating to these types of devices have been issued.

These include U.S. Pat. No. 4,258,359, issued to McLamb, which discloses a portable smoke and motion detector having a mechanically activated motion sensor; U.S. Pat. No. 4,404,550, issued to Shaw, which discloses a portable security device specifically intended for use in luggage; U.S. Pat. No. 4,540,980, issued to Porco, which discloses a portable security alarm including heat sensitive circuitry for the purpose of sensing fires even in the absence of smoke; and U.S. Pat. No. 5,309,145, issued to Branch et al., which discloses a smoke and motion detector that includes circuitry enabling the detector to distinguish between motion indicating the presence of the user and motion of an intrusive character.

None of these devices, however, include storage means for key rings and for the magnetic card keys in use at many modern hotels. Moreover, none of these devices include circuitry enabling the electrical functions of the device to be operated remotely, nor do they include means to dial for assistance automatically in the event of fire, a medical emergency or unwanted intrusion. Furthermore, none of these devices are equipped with a detachable flashlight as an added travel convenience.

For these reasons, none of the above inventions and patents, taken either singly or in combination, is seen to describe the present invention as claimed.

SUMMARY OF THE INVENTION

The present invention is a portable room security system for use in hotel rooms, apartments, vehicles having sleeping areas (such as motor homes, RV's, trailers, etc.) and the like. The system integrates into a single housing and system a smoke detector, a sensor for detection of high-pitched continuous sound such as emitted by other emergency alarms, and a movement sensor, each serially connected to an audio alarm and a visual alerting means. One embodiment of the device includes circuitry which triggers an additional remote alarm via a telephone link at a location such as the front desk of a hotel. This additional circuitry may optionally be wired to a detachably-mounted tape player or digital audio means which automatically plays a pre-recorded message announcing the emergency and asking for help in one of several languages when someone at the remote location answers the automated call. Alternatively, a detachable electronic emergency transponder may be used. The invention further includes a magnetically isolated slot for holding hotel key cards, as well as a series of hooks for holding several keyrings. Also available is a bracket, mounted to the housing, for holding a flashlight. The system is optionally operable using a remote control device.

Two types of structure may be used to suspend the device from an associated door. The first consists of a pliable extension bar and hook which enables the device to be mounted to a door knob. Alternatively, the device is available in a version where a bracket extension piece enables it to be hung from the top of a door. This version is particularly useful to prevent small children from altering the settings. In yet another embodiment, the device is also available in a desk or night table model, where the implements used to hang it from a door or door knob are absent.

Accordingly, it is a principal object of the invention to provide a smoke and motion detecting device which includes a magnetic key slot.

It is another object to provide a smoke and motion detecting device which includes a multiple key-ring holder.

It is a further object to provide a smoke and motion detecting device which includes a detachable flashlight.

Still another object of the invention is to provide a smoke and motion detecting device whose functions may be remote-controlled.

Still a further object is to provide a smoke, sound and motion detecting device whose detection means triggers either an automatic telephone dialing and the automatic playback of a message requesting assistance in the event of intrusion or fire, or, an automatic emergency transponder.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
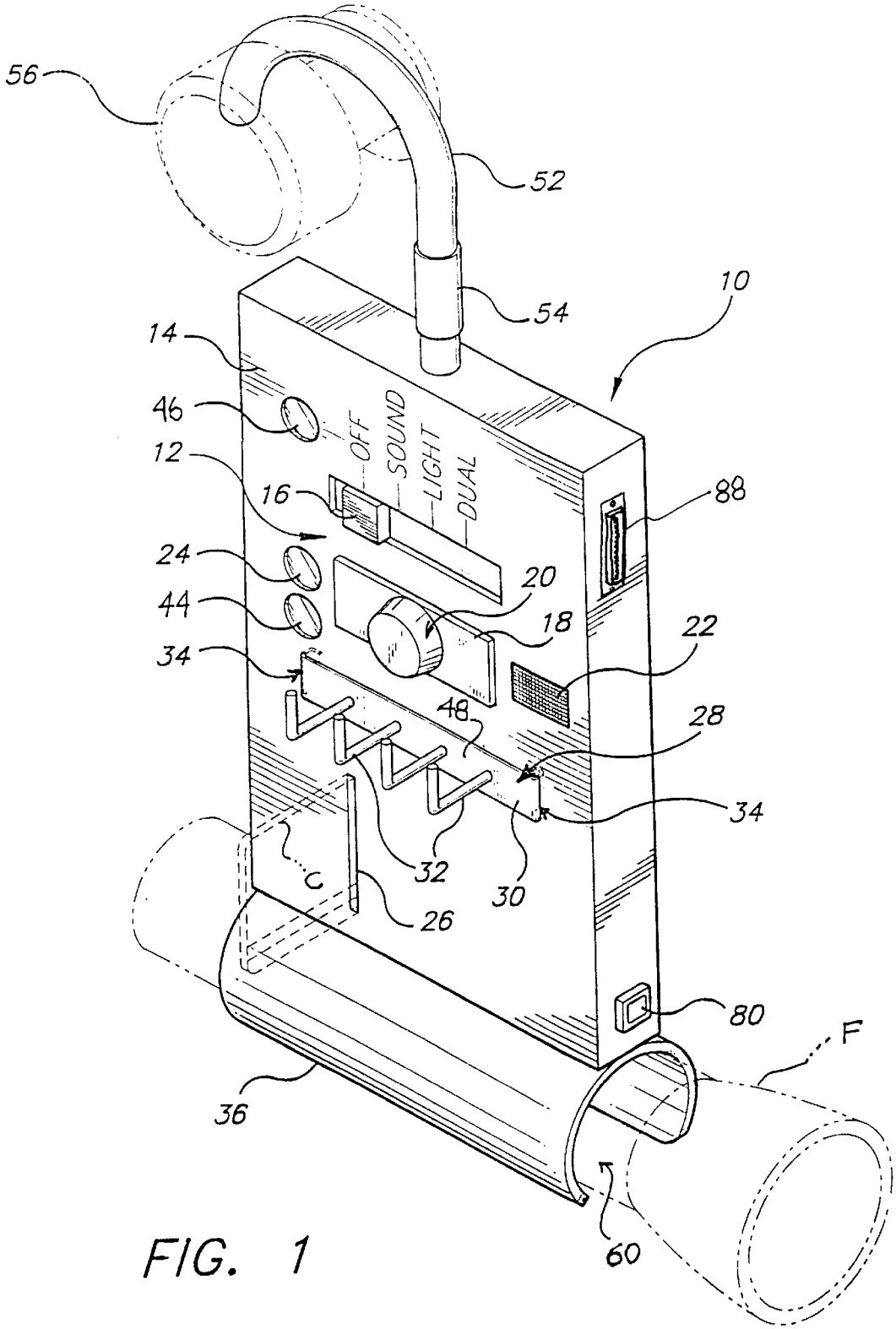
FIG. 1 is an environmental view of the present invention in conjunction with a doorknob from which it is hung.

Referring to the drawings, the present invention is seen to comprise a portable room security device which incorporates at least one of a number of independent features, depending on the embodiment in question. The preferred embodiment, the housing of which is pictured in FIG. 1 and the basic manner of operation of which is pictured in FIG.

2, exemplifies the physical and operational features to be described in what follows.

FIG. 1 depicts a housing 10 with an indicator-and-control console 12 located on its front face 14. The device is operated by means of a manual mode switch 16 having multiple settings, in a manner to be described in more detail below. The front console further includes a port 18 which exposes smoke sensing means 20 to the ambient environment. Additionally, motion-sensing means 44 are located within the housing exposed to ambient by its respective port shown in FIG. 1. Likewise, a sound sensor 46 detecting a high-pitched sound produced by another emergency alarm, such as an institutional alarm for smoke or evacuation circumstances, is included. It is, of course, possible to add other sensors to alert users to other conditions in the ambient environment.

The console also includes a pair of output ports, one equipped with an audible alarm emitter 22, and the second with a brightly flashing light 24 to provide a means of visual alert. Both alerting means are wired to respond to the activation of any one of the condition-sensing means. Regardless of the condition-sensing or alerting means noted and unless otherwise described, electronic components well known in the art may be chosen and adapted by one skilled in the art in a manner consistent with the intended function and combination as described herein.

In addition, the exterior and front wall of the housing 10 includes a slot 26 adapted to store magnetic card keys C such as are commonly employed by hotels. This slot is preferably located in the front surface 14, and is designed to be magnetically isolated from the circuitry located in the interior of the housing. In FIG. 1, a card key C of this type is indicated by means of a dashed line.

A further feature of the invention includes an attachment 28 enabling the user to store a plurality of key rings. Preferably, this feature may comprise a metal strip 30 having a plurality of hooks 32 attached thereto. Two slots 34 defined in the front surface 14 of the housing 10 permit secure attachment of the metal strip 30. The attachment is accomplished by inserting each of the ends of the metal strip 48 into one of the slots and then bending the ends backward, forming a crimp onto the housing 10.

Moreover, a holding bracket 36 for the purpose of storing a removable flashlight F is located at the bottom of the housing 10. This flashlight F is indicated in FIG. 1 by means of a dashed line. In the preferred embodiment, the holding bracket 36 is a flexible and resilient material, such as a preformed plastic sheet, formed as a partial tube, prismatically C-shaped and longitudinally slit to form a mouth 60 for lengthwise insertion of the flashlight F. The partial tube is sized and dimensioned to have a diameter slightly less than that of the flashlight F, thus permitting the holding bracket 36 to form a "flex-fit" or frictionally engage the matingly-sized battery housing of the flashlight F.

Figure 2:
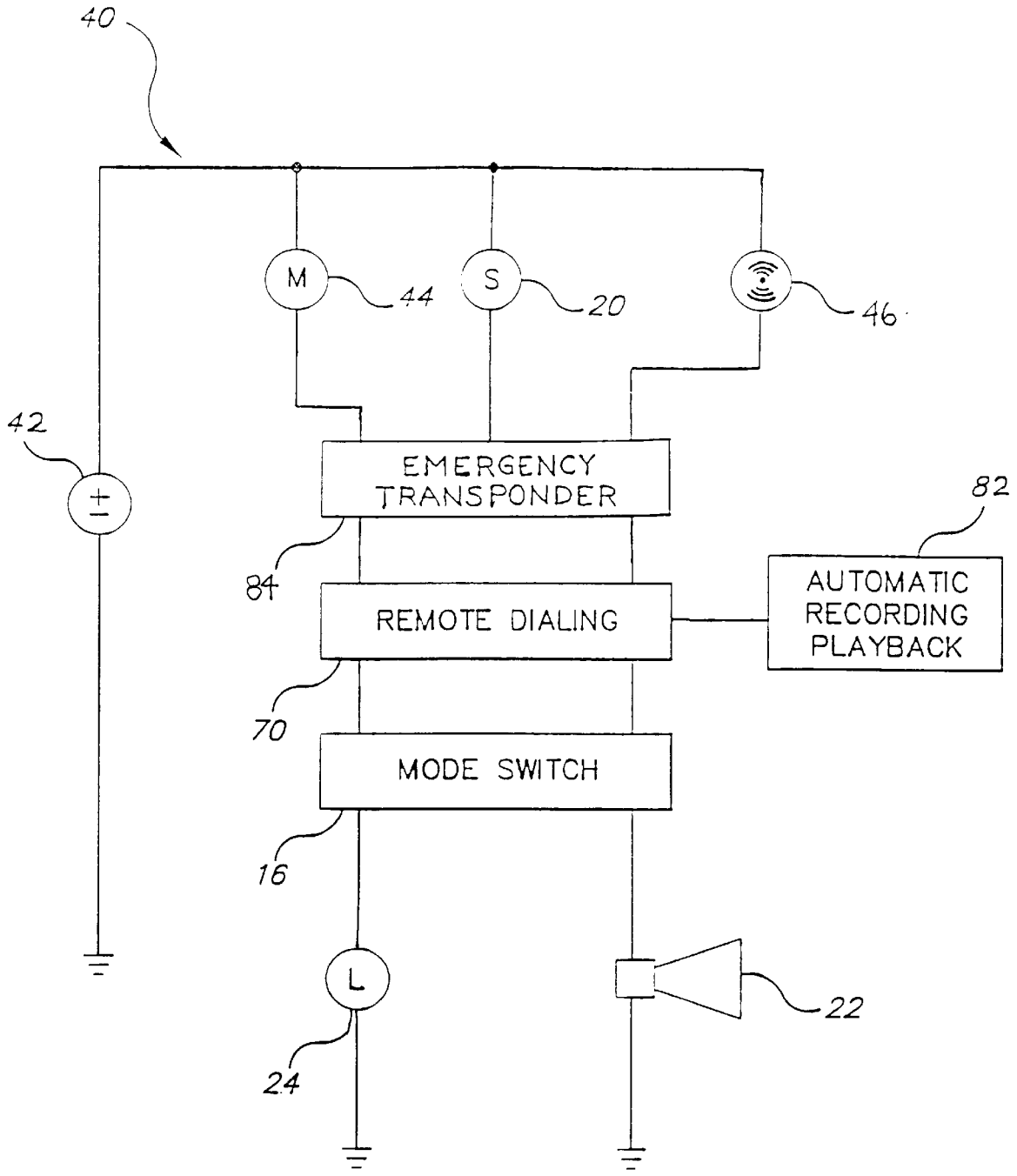
FIG. 2 is a circuit diagram illustrating the basic manner of operation of the present invention.

The basic circuit scheme employed with the present invention in its preferred embodiment is pictured in FIG. 2, and is designated by the general reference numeral 40. It is powered by any one of several commonly available batteries 42, and includes the smoke sensor 20 arranged in parallel with the motion sensor 44 and emergency-alarm sound sensor 46 for detecting a high-pitched, typically continuous duration sound. Any other condition-sensing means which one might desire to add to the present invention would also be included in this parallel arrangement. Such condition-sensing circuitry is serially wired to indicator-means devices, including the audible alarm 22 and the visible flashing light 24. These indicator-means devices are also arranged in parallel, and are serially coupled to the condition sensors by means of the manually operated mode switch 16.

Figure 4:
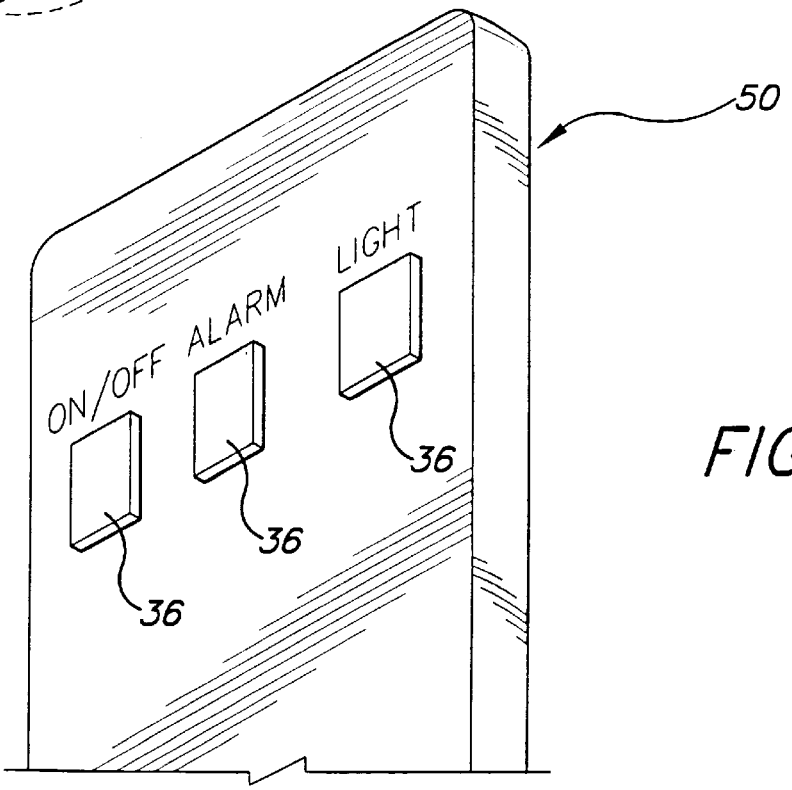
FIG. 4 is a partial perspective view of a remote control element which may optionally be employed with the present invention.

As shown in FIG. 1, this mode switch has the following settings: an off mode which renders the circuitry pictured in FIG. 2 non-operational; an audible alarm mode which serially couples the condition sensors to the alarm 22 only; a visual alarm mode which serially couples the condition sensors to the flashing light 24 only; and a dual mode which serially couples the condition sensors both to the light 24 and to the alarm 22. A battery-operated remote control element 50, pictured in FIG. 4, may be employed to control the circuit modes normally activated by the mode switch on the console. The remote control element assumes the functions of the mode switch by means of three toggle switches 51, which activate and deactivate, respectively, the circuit 40 as a whole, the audible alarm 22, and the flashing light 24. Such remote control 50 may include any known remote activation means, such as electronic transceivers responsive to RF, infrared, sound waves, etc.

Referring again to FIG. 2, a slightly more sophisticated embodiment of this circuit optionally adds automatic dialing means 70 in series with the condition-sensors for the purpose of alerting remote observers to the conditions which activate the condition sensors. This automatic dialing means causes a telephone at a remote location to be automatically dialed and may, for example, be set to dial 911 or the front desk of a hotel in the event of an emergency involving fire or intrusion. Thus, the housing 12 shown in FIG. 1 includes a standard telephone jack 80 as a communication port, enabling this remote dialing link to be established over normal telephone lines.

This additional circuitry supporting the remote dialing feature 70 may optionally be wired to an automatic recording playback device 82 detachably joined to the housing 12 by any of known means in the art, which device 82 automatically plays a pre-recorded message announcing the emergency and asking for help in one of several languages when someone at the remote location answers the automated telephone call. The playback means for playing a pre-recorded audio message may be activated by an electronic response remote to the automatic dialing feature. This second device may employ either a micro-tape recorder or one of several commonly available varieties of digital playback technology, which are housed by a secondary housing having attachment means for cooperatively attaching with the housing of the device. The playback means may be operatively coupled to the main circuitry and responsive to said automatic dialing means by any known jack, plug or other input/output port 88.

Yet another and third device may incorporate a detachable, electronic emergency transponder 84. Such devices, well known in the art, may include a geosynchronous or other satellite positioning system (e.g., GPS). Other electronic devices may be chosen and adapted to include any continuous- or intermittent-signalling device, which signal is sent to a monitoring receiving station. Such signals are preferably dedicated and automatically identified as emergency transponder signals, having sufficient identifying characteristics to ultimately pinpoint the geographic location of the emergency by means of remote tracking devices monitored by the receiving station. Moreover, means for detachably securing a secondary housing which contains the emergency transponder 84 to the main housing 12 in a manner operably coupling the circuitry are known so as to be adapted by one with ordinary skill in the art to accomplish the functions and purposes described. For example, the transponder may be operatively coupled to the main circuitry and responsive to said condition sensing means by any known jack, plug or other input/output port 88.

Figure 3:
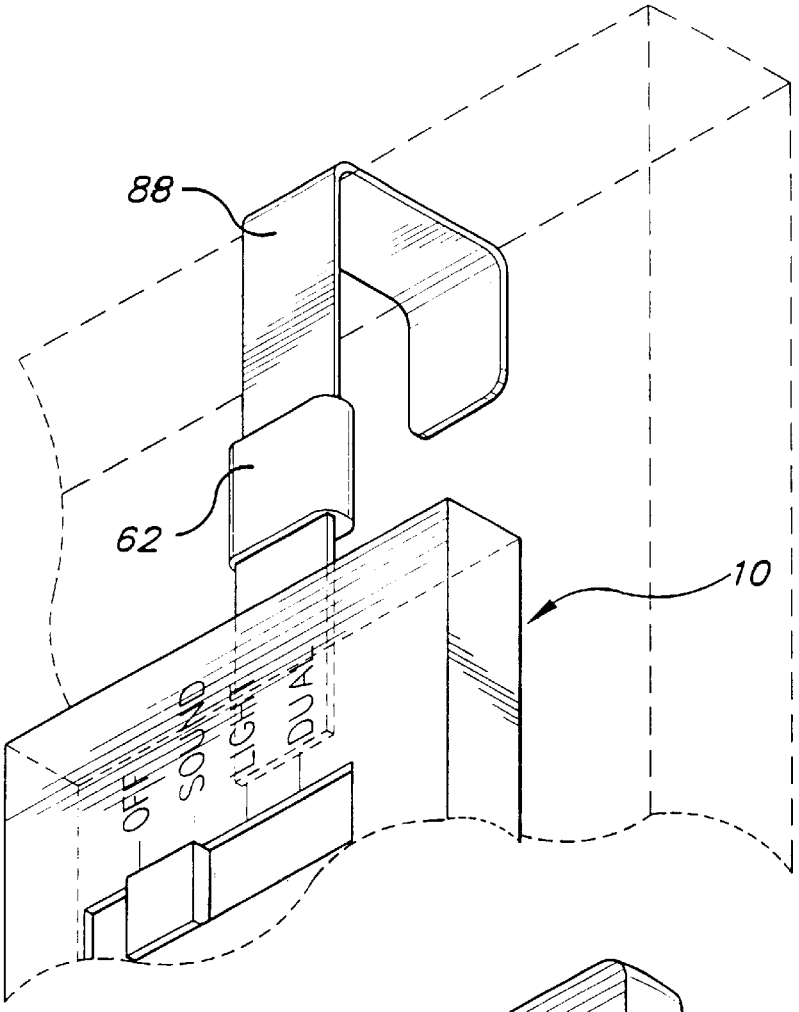
FIG. 3 is a partial environmental view illustrating an alternate embodiment wherein the present invention is hung from the upper ledge of a door.

A final matter is the manner in which the present invention is temporarily mounted to an associated door. In the first embodiment, pictured in FIG. 1, the rear surface of the housing (not shown) has a hook 52 with an extensible shank portion 54 attached thereto, whereby the housing 10 may be hung from a door knob 56. In an alternative embodiment, pictured in FIG. 3, the rear face 58 of the housing includes a bracket hanger 88 and an extensible element 62 for altering the length of the hanger attached thereto, whereby the housing 10 may be hung from the top of a door. In yet another embodiment, the device is also available in a desk or night table model, where the implements used to hang it from a door or door knob are absent.

It is to be understood that the present invention is not limited to the embodiments described above, but encompasses any and all embodiments within the scope of the following claims.

What is claimed is:

1. A portable room security device comprising:

a housing having an exterior surface and defining an interior chamber, said exterior surface including a front face, a rear face, and a bottom face;

circuitry housed in said chamber including:

a plurality of condition sensors; and alerting means for alerting an individual to the conditions which activate said condition sensors, wherein said alerting means includes automatic dialing means for alerting remote observers to the conditions which activate said condition sensors attachment means for securing said housing to a door; and holding means on said surface for securing auxiliary devices.

2. The portable room security device recited in claim 1, further including a standard telephone port enabling said automatic dialing means to utilize standard telephone lines.

3. The portable room security device recited in claim 1, further including playback means for playing a pre-recorded audio message to remote observers, said playback means activated by an electronic response to said automatic dialing means.

4. The portable room security device recited in claim 3, wherein said playback means is housed by a secondary housing having attachment means for cooperatively attaching with said housing and operatively coupling to said circuitry and responsive to said automatic dialing means.

5. The portable room security device recited in claim 3, wherein said playback means is selected from the group consisting of a micro-cassette player and digital playback means.

6. A portable room security device comprising:

a housing having an exterior surface and defining an interior chamber, said exterior surface including a front face, a rear face, and a bottom face;

circuitry housed in said chamber including:

a plurality of condition sensors; and alerting means for alerting an individual to the conditions which activate said condition sensors;

an emergency transponder for sending a signal to a remote monitoring station, said transponder housed in a secondary housing having attachment means for cooperatively attaching with said housing and operatively coupling to said circuitry and responsive to said condition sensing means;

attachment means for securing said housing to a door; and holding means on said surface for securing auxiliary devices.

7. The portable room security device recited in claim 6 wherein said emergency transponder sends a signal dedicated and having sufficient identifying characteristics to pinpoint the geographic location of the emergency by means of remote tracking devices.

* * * * *